US005160034A

United States Patent [19]

Potter

[11] Patent Number: 5,160,034

[45] Date of Patent: Nov. 3, 1992

[54] VIBRATING BUCKET SCREEN FOR BEACHES

[76] Inventor: Robert J. Potter, Rte. 6, Box 544, Buffalo, Minn. 55313

[21] Appl. No.: 845,761

[22] Filed: Mar. 2, 1992

Related U.S. Application Data

[63] Continuation of Ser. No. 531,783, Jun. 1, 1990, abandoned.

[51] Int. Cl.[5] ..... B03C 1/30

[52] U.S. Cl. ..... 209/38; 37/117.5; 37/118 A; 37/DIG. 18; 171/74; 171/135; 209/235; 209/326; 209/405; 209/420

[58] Field of Search ..... 209/38, 235, 243, 325, 209/326, 332, 366, 405, 415, 420, 421; 37/8, 55, 57, 71, 99, 107, 117.5, 118 A, 141 R, DIG. 18; 171/71, 74, 135, 136

[56] References Cited

U.S. PATENT DOCUMENTS

| | | | |
|---|---|---|---|
| 1,301,643 | 4/1919 | Blank . | |
| 1,787,852 | 1/1931 | Behnke et al. | 209/326 |
| 2,441,591 | 5/1948 | Owen | 214/78 |
| 2,525,384 | 10/1950 | Troutman | 214/78 |
| 2,824,655 | 2/1958 | Harbers | 214/78 |
| 3,003,635 | 10/1961 | Wood | 280/415 |
| 3,072,257 | 1/1963 | Hockenberry | 209/421 |
| 3,112,573 | 12/1963 | Moras et al. | 37/145 |
| 3,142,341 | 7/1964 | de Biasi | 171/136 |
| 3,149,737 | 9/1964 | Guinot | 214/135 |
| 3,362,480 | 1/1968 | Barber | 171/87 |
| 3,395,798 | 8/1968 | Erickson | 209/260 |
| 3,458,069 | 7/1969 | Wickberg et al. | 214/145 |
| 3,461,968 | 8/1969 | Longley | 209/421 |
| 3,477,573 | 11/1969 | Andersson | 209/421 X |
| 3,561,777 | 2/1971 | Geis | 280/7.12 |
| 3,630,301 | 12/1971 | Henricks | 280/7.14 X |
| 3,732,980 | 5/1973 | Evers et al. | 209/421 |
| 3,765,490 | 10/1973 | Logue | 171/132 |
| 3,845,796 | 11/1974 | Moore | 37/117.5 X |
| 3,979,146 | 9/1976 | Berg | 294/55 |
| 4,157,956 | 6/1979 | Robinson | 209/421 X |
| 4,162,968 | 7/1979 | Gelhaus | 209/400 |
| 4,197,194 | 4/1980 | Read | 209/325 |
| 4,224,146 | 9/1980 | Kent et al. | 209/243 |
| 4,242,035 | 12/1980 | Hornstein | 414/724 |
| 4,250,025 | 2/1981 | Causton et al. | 209/38 |
| 4,256,572 | 3/1981 | Read | 209/325 X |
| 4,422,819 | 12/1983 | Guest | 414/724 |
| 4,470,610 | 9/1984 | Wilson | 280/7.14 X |
| 4,494,611 | 1/1985 | Alvarez | 209/616 X |
| 4,547,984 | 10/1985 | Adams | 37/117.5 X |
| 4,640,364 | 2/1987 | Thuerer | 209/421 X |
| 4,698,150 | 10/1987 | Wigoda | 209/421 |
| 4,778,190 | 10/1988 | Merideth | 280/7.12 |
| 4,892,359 | 1/1990 | Ottestad | 37/141 X |

FOREIGN PATENT DOCUMENTS

| | | | |
|---|---|---|---|
| 1282554 | 2/1964 | Fed. Rep. of Germany . | |
| 2741942 | 9/1972 | Fed. Rep. of Germany . | |
| 2227399 | 11/1970 | France | 37/117.5 |
| 2265464 | 3/1974 | France . | |
| 2412663 | 8/1979 | France | 209/421 |
| 2447423 | 9/1980 | France | 209/421 |
| 1097384 | 6/1984 | U.S.S.R. | 209/235 |
| 1291555 | 10/1972 | United Kingdom . | |
| 2027096 | 2/1980 | United Kingdom | 37/117.5 |
| 8803200 | 5/1988 | World Int. Prop. O. | 37/103 |

OTHER PUBLICATIONS 3-page, brochure H. Barber & Sons—Litter Picker.

4-page, brochure Rockland—Beach Cleaning Machines.

2-page brochure Rockland—Beachcomber.

2-page, Rockland brochure Prices & Bid Specifications.

1-page, brochure The Barber Surf Rake.

*Primary Examiner*—Kevin P. Shaver

*Assistant Examiner*—Joseph A. Kaufman

*Attorney, Agent, or Firm*—Palmatier & Sjoquist

[57] ABSTRACT

The present vibrating bucket screen attachment for cleaning beaches and for being mounted on mobile machines such as skid-steer loaders includes an outer excavating bucket with a sand-scooping blade and runners on the outer bucket for supporting the outer bucket relative to the beach. An inner vibrating screen bucket is resiliently mounted in the excavating bucket and includes a hydraulically operated vibrator. Resilient bumper pad mounts disposed between the inner and outer buckets suppress the vibrations of the inner vibrating bucket relative the outer excavating bucket. A floor screen portion of the inner bucket is mounted above bottom, sand-engaging portions of the outer bucket such that the screen portion is spaced from the surface of the beach to vibrate freely during the separation of sand from litter.

23 Claims, 7 Drawing Sheets

VIBRATING BUCKET SCREEN FOR BEACHES

This is a continuation of copending application Ser. No. 07/531,783 filed on Jun. 1, 1990, now abandoned.

The present invention relates to bucket attachments for connection to the arm structure and hydraulic system of a mobile machine such as a skid-steer loader and, more particularly, to a vibrating bucket screen attachment for such a mobile machine.

BACKGROUND OF THE INVENTION

The national shoreline of the United States is 32,344 miles long, excluding Alaska and Hawaii. See the National Shoreline Study, U.S. Army Corps of Engineers, 1971. Although sixty percent of the shoreline may have been undeveloped in 1971, 40% had been classified as either devoted to public recreation, private recreation or non-recreational developed. Thirty percent or about 10,983 miles of the shoreline meets the criteria of a beach where, according to the Army Corps of Engineers, a beach is defined as the area with sand between high and low tide. Of course, the 10,983 miles of beach shoreline does not include the numerous beaches found adjacent to inland lakes and rivers such as the Great Lakes or Mississippi River.

Beaches exist in a variety of types. For example, open beaches with widths of over one hundred yards may run for over a mile. Smaller beaches, especially around retirement communities, may be secluded and dotted with palm trees. Some beaches are soft, others are hard. Some beaches include coral sand, others comprise volcanic or glacial sand.

The cleaning of beaches is a slow and difficult task, whether accomplished by hand or machine. When a beach is hand-cleaned, only the larger, visible items such as pop and beer cans are found. Smaller items such as nails or hairpins remain dangerously hidden in the sand. Manually labor is typically employed to clean the private secluded beaches because the large, complex beach cleaning machines are prohibitively expensive. Moreover, the massive beach cleaning machines are difficult to maneuver where beach areas include obstructions such as trees, boulders and docks.

SUMMARY OF THE INVENTION

A feature of the present invention is the provision in a vibrating bucket screen attachment for picking up litter from a sandy beach and for connection to the arm structure and hydraulic system of a mobile machine such as a skid-steer loader, of an inner vibrating screen mounted in an outer, primary excavating bucket and spaced above a cutting edge of a sand-scooping blade and a bottom portion of the primary bucket which engages and slides on the beach.

Another feature is the provision in such a vibrating bucket screen attachment, of the screen being resiliently mounted in the primary bucket.

Another feature is the provision in such a vibrating bucket screen attachment, of means for adjusting the amplitude of the vibrations of the screen.

Another feature is the provision in such a vibrating bucket screen attachment, of an adjustable blade which may be disposed to penetrate the sand at different depths.

Another feature is the provision in such a vibrating bucket screen attachment, of a harp-type screen that includes screen wires running parallel to each other with no cross-over screen wire such that sand is screened more quickly.

Another feature is the provision in such a vibrating bucket screen attachment, of support means on the frame for supporting the attachment relative to the the beach and being adjustable to aid in disposing the cutting edge of the blade at a prescribed depth.

Another feature is the provision in such a vibrating bucket screen attachment, of a roller broom disposed adjacent to the blade for sweeping sand and litter onto the screen, and of the roller broom being swingable to an out-of-the-way position.

Another feature is the provision in such as vibrating bucket screen attachment, of an electromagnet traversing the screen adjacent to the cutting blade for picking up small pieces of metallic litter which otherwise would pass through the screen.

An advantage of the present invention is that it is inexpensive relative to other beach cleaning machines.

Another advantage is that beaches are cleaned quickly. The present bucket screen attachment cleans about one hundred feet per minute while traversing a six foot span and while picking up items as small as bobby pins.

Another advantage is that litter is cleanly separated from the sand. The present bucket attachment conveys sand from a scooping blade onto a screening bucket spaced from the surface of the beach and isolated via the resilient mounts from the primary bucket. Such spacing and isolation permit a free unhindered vibration for quick separation of the sand from the litter.

Another advantage is that the inner vibrating bucket screen is readily mountable in and removable from the primary excavating bucket. A set of typically four resilient mounts are easily aligned to provide for the quick connection.

Another advantage is ease of operation. Skis or wheels on the primary excavating bucket permit the operator of the skid-steer loader to easily dispose the cutting edge of the blade at a uniform depth.

DESCRIPTION OF THE PREFERRED EMBODIMENT

Figure 1:
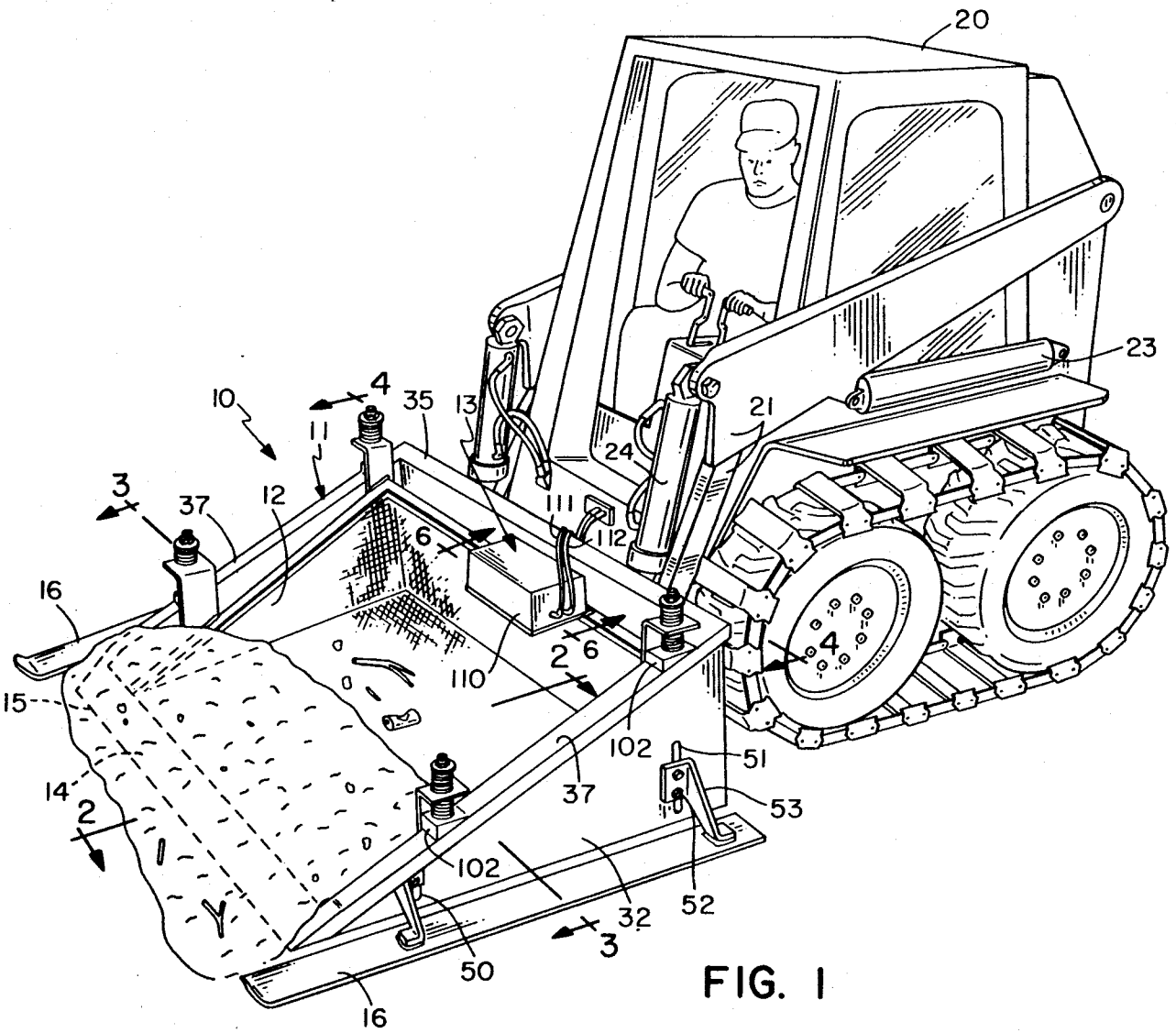
FIG. 1 is a perspective view of the vibrating bucket screen attachment connected to the arm structure and hydraulic system of a skid-steer loader.

As shown in FIG. 1, the present vibrating bucket screen attachment is generally indicated by reference numeral 10 and includes as its principal components a primary excavating bucket or frame 11, an inner bucket screen 12 with a vibrator 13, an elongate blade 14 with a cutting edge 15, and a pair of runners or skis 16.

The attachment 10 is connectable to a mobile machine such as a skid-steer loader 20. The skid-steer loader 20 includes a pair of bucket or lift arms 21 with distal connecting ends 22 for connection to the attachment 10. The lift arms 21 are operated by a pair of lift hydraulic cylinders 23. A pair of dump or tilt hydraulic cylinders 24 are pivotably connected to the lift arms 21 and to the attachment 10 via distal piston ends 25.

The primary excavating bucket 11 includes a one-piece integral frame comprising a generally rectangular rear plate 31 integrally formed with a pair of generally triangular side plates 32 extending forwardly from the rear plate 31. The rear plate 31 includes two pairs of rigid apertured ears 33 for connection to the arm structure of the skid-steer loader 20. Upper apertured portions of the ears 33 are connected to the distal ends 25 of the tilt hydraulic cylinders 24 via pin connectors 42. Lower apertured portions of the ears 33 are connected to the distal ends 22 of the lift arms 21 via pin connectors 43.

An angled flange 35 extends rearwardly from an upper portion of the rear plate 31 and runs parallel to and opposite of a bottom edge 36 of the rear plate 31. The flange 35 is formed integrally with a pair of oblique, outwardly extending angled flanges 37 on the side plates 32. Opposite of the oblique flanges 37, the side plates 32 include inwardly extending flanges 38. Each of the inwardly extending flanges 38 includes a bottom surface portion 39 which engages and slides on the beach. Although use of the skis 16 is preferred, the attachment 10 may be utilized without skis 16 with the bottom portions 39 engaging and sliding on the beach.

The triangular side plates 32 are held in a spaced apart relationship by the rear plate 31 and the blade 14, which may be rigidly affixed between inner front portions of the plates 32. An open bottom portion 40 is provided between the flanges 38 of the side plates 32 to allow sand screened by the screening bucket 12 to fall back to the beach.

The pair of skis 16 are adjustably affixed to the primary bucket 11 via respective, front and rear slots 50, 51. Each of the slots 50, 51 is generally vertically formed in its respective side plate 32. Pin connectors 52 of the bracket-like ski mounts 53 extend through slots 50, 51 to affix the skis 16 to the primary bucket 11. A raising or lowering of the ski mounts 53 in the slots 50, 51 dispose the cutting edge 15 of the blade 14 at a prescribed depth relative the surface of the beach on which the skis 16 slide. Typically, the cutting edge 15 of the blade 14 lies in the same plane as the bottom surface portions 39 of the flanges 38. Accordingly, if the cutting edge 15 traverses the beach at a two inch depth, the bottom surface portions 39 follow at such a two inch depth.

The inner vibrating screen bucket 12 includes a generally rectangular horizontal floor portion bounded by front and rear angle iron support members 70 and 71 and side angle iron support members 72, 73 which are rigidly affixed between the front and rear support members 70, 71. Flat steel standing or bars or strips 74 are rigidly connected between the front and rear support members 70, 71. Reinforcing corner gussets 75 are rigidly affixed in the four corners of the floor portion. A rectangular floor section of screen cloth 76 is supported by and affixed to the support members 70–73, bar 74 and gussets 75.

The inner vibrating screen bucket 12 further includes a rear bucket portion bounded by rear, lower support member 71 of the floor portion, and upper angle iron support member 80, and outer generally upright angle iron support members 81, 82, which are rigidly affixed between support members 71, 80. Reinforcing corner gussets 83 are rigidly affixed in the four corners of the rear bucket portion. A bent plate 84 for mounting the vibrator 13 is rigidly affixed between the lower and upper support members 81, 80. A pair of oblique, reinforcing angle iron support members 85.1 are affixed between upper portions of the bent plate 84 and lower gussets 83. It should be noted that the rear screen bucket portion and angle irons 81, 82 are tilted slightly forwardly relative to the rear plate 31 of the primarily bucket 11. A rectangular rear section of screen cloth 85 is affixed to and supported by the support members 71, 80, 81, 82, gussets 83, bent plate 84, and oblique support members 85.1.

The inner vibrating screen bucket 12 further includes generally triangular side portions bounded by respective side, lower support members 72, 73, respective outer, rear support members 81, 82, and oblique, downwardly and forwardly extending support members 90, and front upright angle iron support members 91. Support members 82, 91 are rigidly affixed between support members 72, 90. Generally triangular side sections of screen cloth 92 are affixed to and supported by their respective support members 72, 73, 81, 82, 90, 91.

Figure 6:
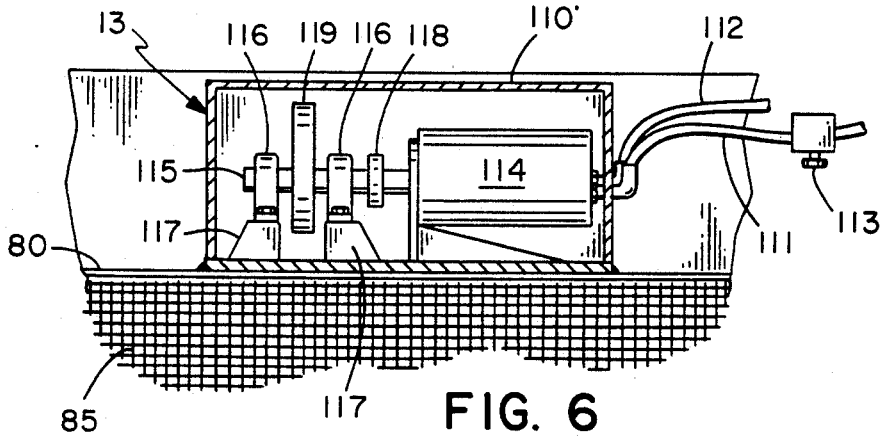
FIG. 6 is a detail, elevation cut away view at lines 5—5 of FIG. 1.

The sections of screen cloth 76, 85, 92 are typically integrally connected to each other to be formed of one piece. The screen cloth may be of a cross-over type screen as shown in FIG. 6. The screen gauge typically ranges from one-eighth to three inches.

The inner vibrating screen bucket 12 is typically mounted in the primary bucket 11 via a set of four resilient mounts 100. Each of the mounts 100 include an apertured angle bracket 101 rigidly affixed such as by welding to one of the oblique support members of the screen bucket 12 and an apertured angle bracket 102 affixed to one of the oblique flanges 37 of the primary bucket 11. A threaded rod 103 with lock nuts 103.1 mount a pair of resilient, compression springs 104. The springs 104 are disposed o either side of the angle bracket 101 connected to the inner screen bucket 12. With the mounts 100 connected to the oblique support members 90 of the screen bucket 12, the compression springs 104 bear against the angle brackets 102 on the flanges 37 on the primary bucket 11 and the angle brackets 101 on the inner screen bucket 12, and washers 105 on a top portion of the threaded rod 103.

Figure 2:
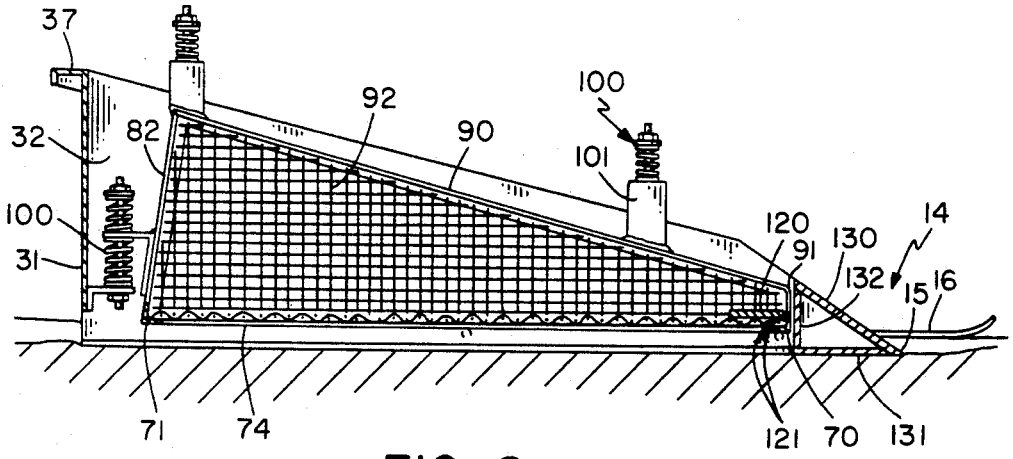
FIG. 2 is a detail section view at lines 2—2 of FIG. 1.
Figure 3:
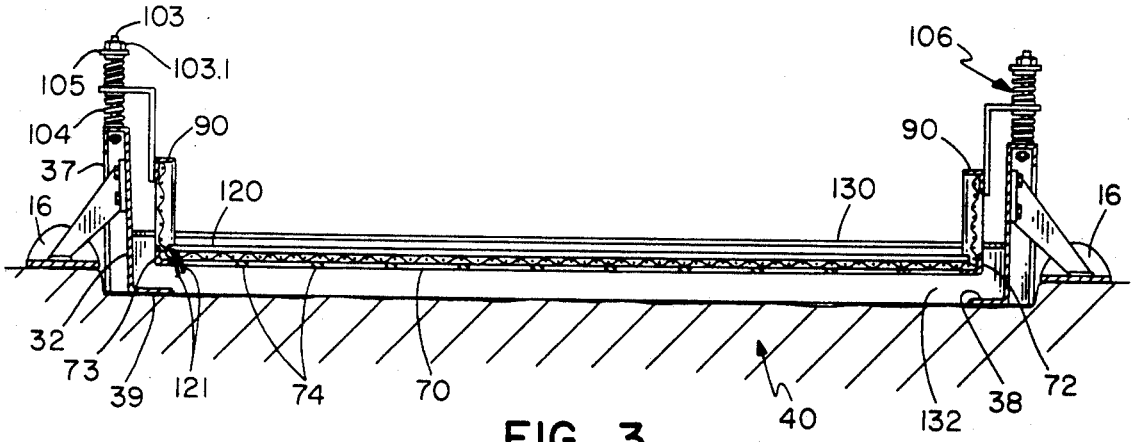
FIG. 3 is a detail section view at lines 3—3 of FIG. 1.
Figure 4:
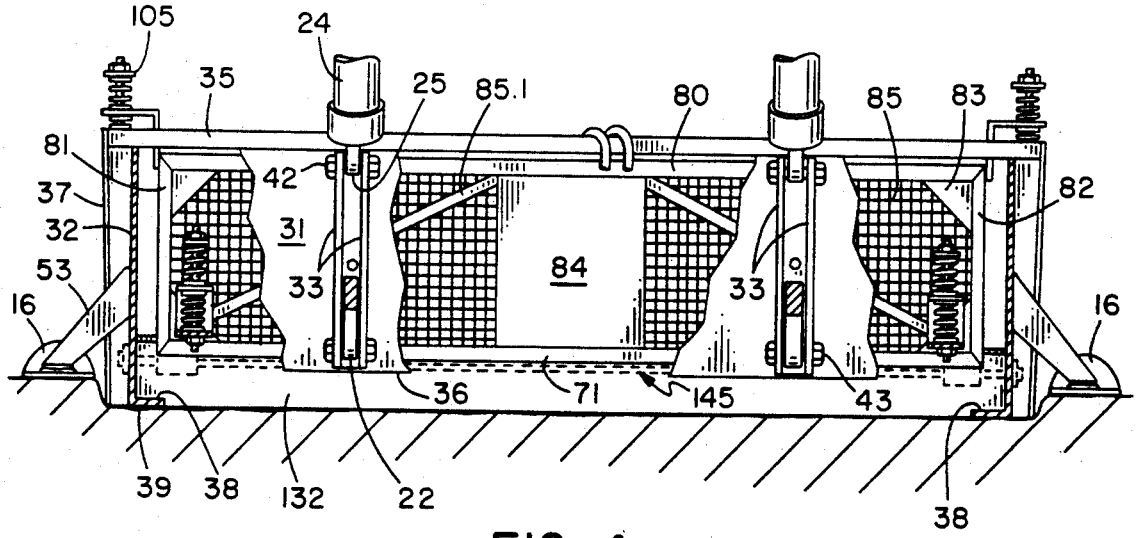
FIG. 4 is a detail rear elevation view at lines 4—4 of FIG. 1.
Figure 5:
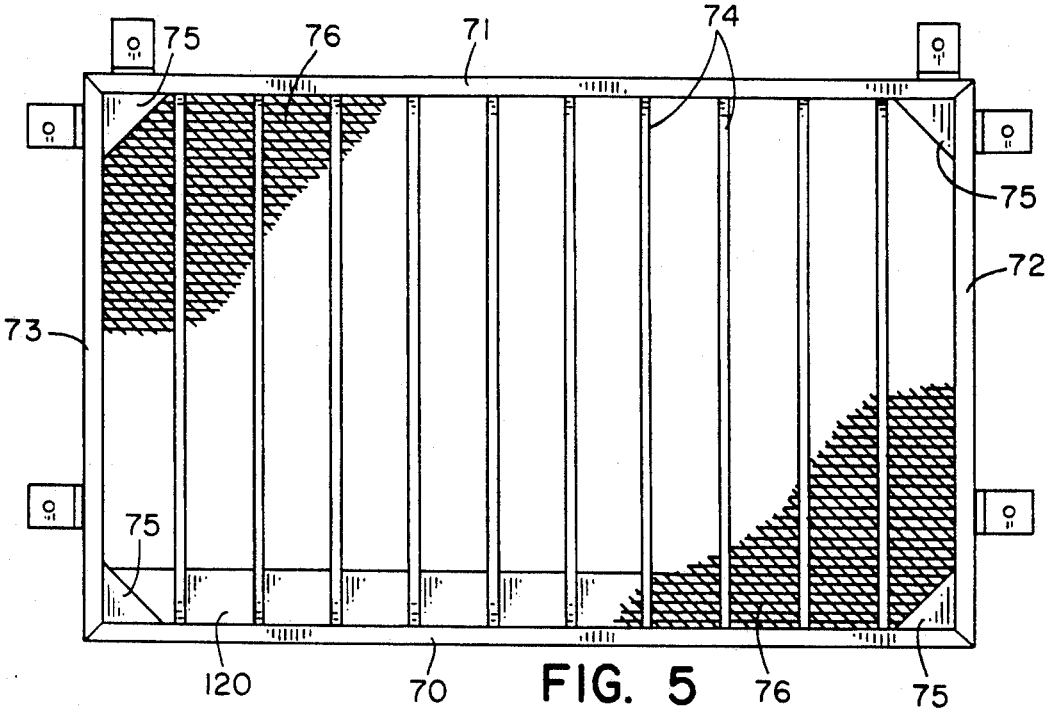
FIG. 5 is a detail bottom elevation view of the bucket screen attachment of FIG. 1.

It should be noted that the attachment 10 may include an additional pair of rear, lower resilient mounts 100. As shown in FIGS. 2 and 4, angle brackets 101 are connected to lower gussets 75 of the inner screen bucket 12 and angle brackets 102 are connected to the rear plate 31 of the primary bucket 11. One compression spring 104 extends between the angle brackets 101, 102; the other compression spring 104 is mounted between angle bracket 101 connected to the screen bucket 12 and a washer 105 on top of a threaded rod 103.

The lock nuts 103.1 of the resilient mounts 100 may be turned up or down on the threaded rod 103 to control the amplitude of the vibrations of the screen bucket 12. When the springs 104 are compressed by adjustment of the lock nuts 103.1, the amplitude of the vibrations decreases. When the springs 104 are decompressed, the amplitude of the vibrations is increased. It should be noted that the amplitude of vibrations at a frontward portion of the screen bucket 12 may be increased relative to a rearward portion of the screen by either decreasing the compression of the forwardly disposed mounts 100 or increasing the compression of the rearwardly disposed mounts 100. Likewise, the amplitude of vibrations at a rearward portions of the screen bucket 12 may be increased relative the front portion by adjustment of the forward and rearward mounts 100.

The vibrating screen bucket 12 further includes the vibrator 13 which is mounted on the bent plate 84. The vibrator 13 includes a housing 110 and hydraulic feed and return lines 111, 112, which run from the hydraulic system of the skid-steer loader 20 to the vibrator 13. The feed line 111 includes a variable speed flow control valve 113 for increasing the frequency of the vibrations of the vibrating screen bucket 12. The vibrator 13 includes a Char-Lynn ® hydraulic motor 114 bearing a Model No. 128-0012-002 available from Power Systems in Eden Prairie, Minn. The motor 114 drives a shaft 115 mounted in pillow block bearings 116. The bearings 116 and motor 114 are set on braces 117 in the housing 110. The vibrator 13 further includes a flex-coupling 118 and an eccentric or off-center weight 119 on the shaft 115. The motor 114 may be driven at 500–1400 rpm with 1–5 gallons of hydraulic fluid per minute for 500–1400 vibrations per minute of the vibrating bucket 12. An electrically operated vibrator may also be used.

The vibrating screen bucket 12 further includes an electromagnet 120 on a front portion of the screen cloth floor section 76. The electromagnet 120 extends between the lower support members 72, 73. Leads 121 extend from the electromagnet 120 to the skid-steer loader 20. The electromagnet 120 picks up small items such as nails which otherwise may pass through the screen cloth floor section 76.

The blade 14 is affixed between lower, front ends of side plates 32 and is triangular in cross-section. The blade 14 includes an elongate oblique flat piece 130 formed of steel or a hardened metal and includes the elongate cutting edge 15. An elongate bottom flat piece 131 and an elongate upright flat piece 132 are affixed to flat piece 130 and are affixed at right angles to each other. The blade 14 may be enclosed at both ends to prevent the entry of sand.

In operation, the inner vibrating bucket 12 is readily set in the primary bucket 11 by aligning the angle brackets 101 of the vibrating bucket 12 with the angle brackets 102 of the primary bucket 11. The brackets 101, 102 are then connected with the threaded rods 103, lock nuts 103.1, and compression springs 104. The prescribed amplitude of the vibrations of the screen bucket 12 is subsequently set by turning the lock nuts 103.1. The variable speed control 113 is adjusted to set the desired frequency of the vibrations. The altitude of the skis 16 relative to the cutting edge 15 is typically set so that the cutting edge 15 and bottom surface portions 39 and the flanges 38 dig into the beach at a two inch depth.

The primary bucket 11 is then connected to the skid-steer loader 20. The lift arms 21 and tilt cylinders 24 are connected to the ears 33 and the hydraulic lines 111, 112 are connected to the vibrator 13, which is turned on. The skid-steer loader 20 is then driven on the beach to be cleaned with the tilt arms 21 bringing the skis 16 to engage and slide on the surface of the beach. As the beach is traversed as such, the cutting edge 15 digs into the beach and sand and litter flows up oblique portion 130, over electromagnet 120, and on to the vibrating floor screen portion 76, and perhaps the vibrating side screen portions 92. The vibrations of the screen portions 76, 92 facilitate the screening of the sand, which passes through the screen portions 76, 92 and falls back to the beach. Litter remains in the screen bucket 12, and metallic items may cling to the electromagnet 120. The electromagnet 120 is operable from the cab of the skid-steer loader 20 so that if larger metallic items adhere to the front of the bucket 12 and obstruct the scooping of sand, the electromagnet 120 may be turned off until the larger metallic item is conveyed to the rear of the screen bucket 12. When it is desired to dump collected litter from the screen bucket 12, the skid-steer loader 20 is driven to a dumpster and the lift arms 21 and tilt cylinders 24 are operated to dump the bucket 12.

It should be noted that the sand typically passes through the floor portion before it has travelled about one-third of the distance from the front support member 70 to the rear support member 71 of the screen bucket 12. This result is obtained when the gauge of the criss-cross screen cloth is 7/16 inches, the sand screened is of the glacial type, the hydraulic vibrating frequency is at 500–1400 vibrations per minute, the amplitude of the vibrations is set at ⅜ inches and the skid-steer loader is being driven at 2 mph.

Figure 7:
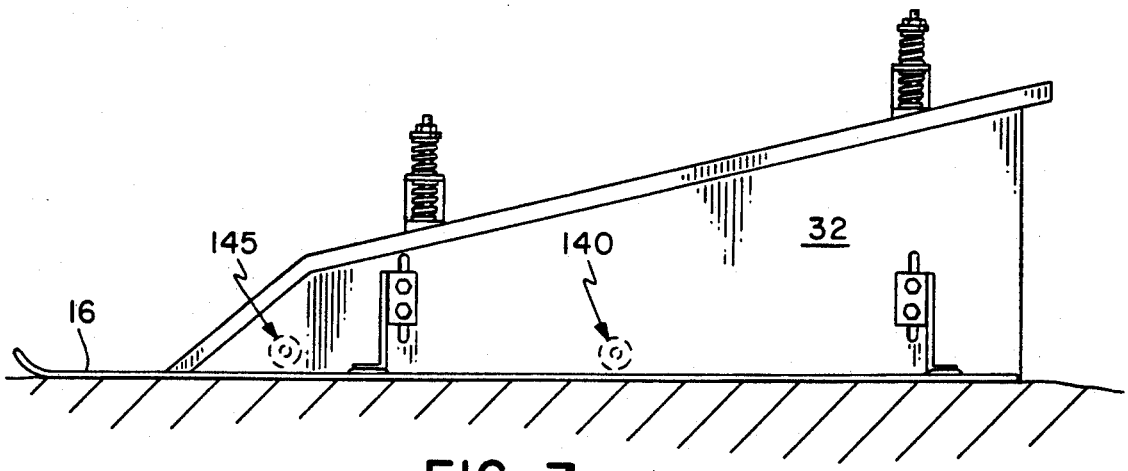
FIG. 7 is side elevation view of an alternate embodiment of the invention showing transverse hinge mechanisms.

As shown in FIGS. 4 and 7, an alternate embodiment of the invention includes a screen bucket 12 hinged to the primary bucket 11 via a transverse hinge 140 on a central portion of the screen bucket 12. Such an embodiment includes steel pipe or tube sections 141 welded to central bottom portions of the support members 72, 73 of the screen bucket 12. Rubber tube or hydraulic hose sections 142 are disposed axially in the steel tube sections 141 to suppress vibrations and cushion the vibrating screen bucket 12 from the primary bucket 11. The length of tubes 141, 142 is approximately equal to the distance between support members 72, 73. A rod 143 extends axially through the the rubber tube sections 142 and through each of the side plates 32 to which the rod 143 is rotatably connected. Such a transversely hinged screen bucket may minimize the amplitude of the vibrations about the central portion of the screen and maximize the amplitude of the vibrations at the front and rear portions of the screen.

Another embodiment of the invention includes a screen bucket 12 hinged to the primary bucket 11 via a transverse hinge 145 mounted on a front portion of the screen bucket 12. Except for the location, the hinge 145 is identical to hinge 140. The hinge 145 is fixed to the front portion of the screen bucket 12 below the electromagnet 120 and adjacent to the blade 15. At such a location, the hinge 145 may minimize the amplitude of vibrations at the front of the screen bucket 12 and maximize the vibrations at a rear portion of the screen bucket 12.

Figure 8:
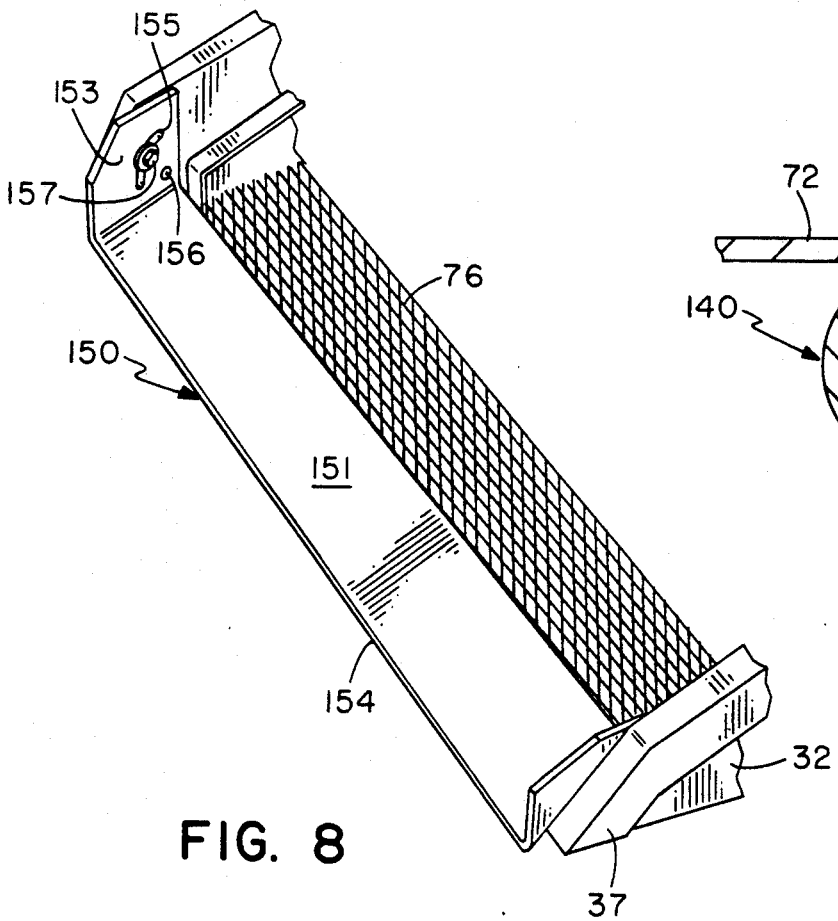
FIG. 8 is a partial perspective view of an alternate embodiment of the invention showing an adjustable blade for penetrating the beach at various depths.
Figure 7A:
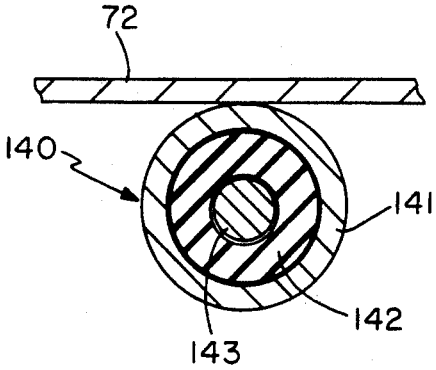
FIG. 7*a* is a cross-section partial view of one of the transverse hinge mechanisms.

As shown in FIG. 8, an adjustable blade 150 is mounted between front portions of the side plates 32. The blade 150 is typically a one-piece plate with an oblique portion 151 and opposing side portions 153. The oblique portion 152 includes a cutting edge 154. Each of the side portions 153 includes a curvilinear slot 155 and is connected to the front portions of its respective side plate 32 via a pivot pin 156 and a removable pin connector 157 in the slot 155. The blade 150 is pivotable about pivot 156 such that the cutting edge 154 is disposed at the prescribed depth relative the skis 16 or bottom surface portions 39 of flanges 38. With only the cutting edge 154 and a lower section of the oblique portion 151 engaging the beach, resistance between the attachment 10 and the beach is minimized.

Figure 9:
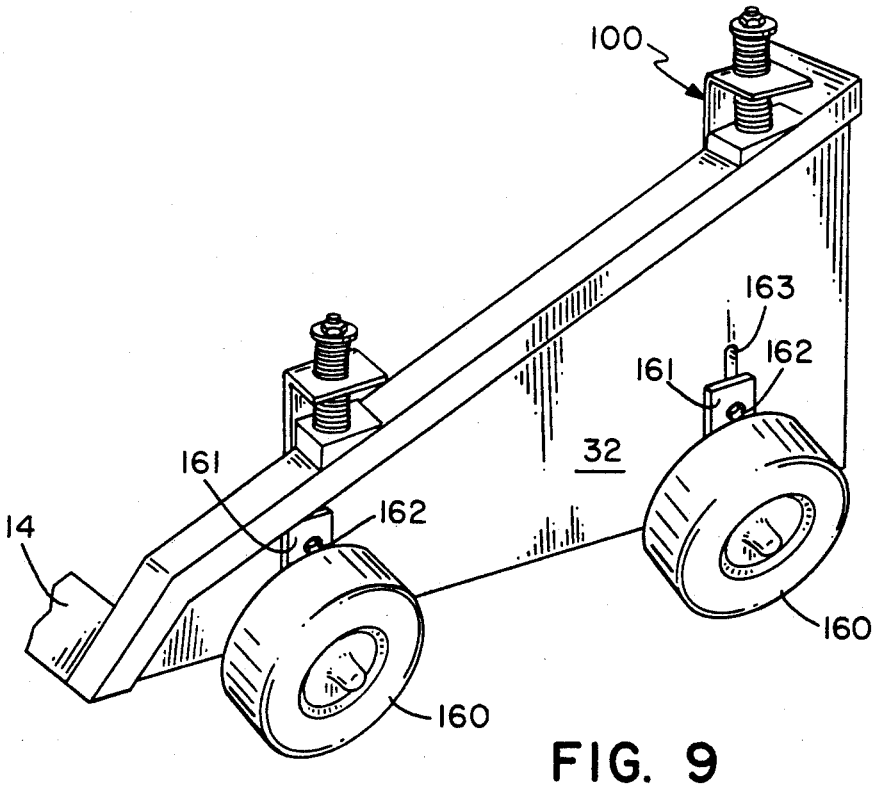
FIG. 9 is a partial perspective view of an alternate embodiment of the invention showing wheels for supporting the attachment relative the beach.

As shown in FIG. 9, an alternate embodiment of the invention includes wheels 160 instead of skis 16. The wheels 160 are mounted on each of the side plates 32 via mounts 161. Each of the mounts 161 include pin connectors 162 cooperating with slots 163 formed in side plates 32. Such independent mounting of the wheels 160 allows the primary bucket 111, and blade 150, or blade 14, to be disposed horizontally, or at an angle, relative to the surface of the beach. The wheels 160 are typically utilized on the harder beaches. The skis 16 are typically utilized on soft sand.

Figure 10:
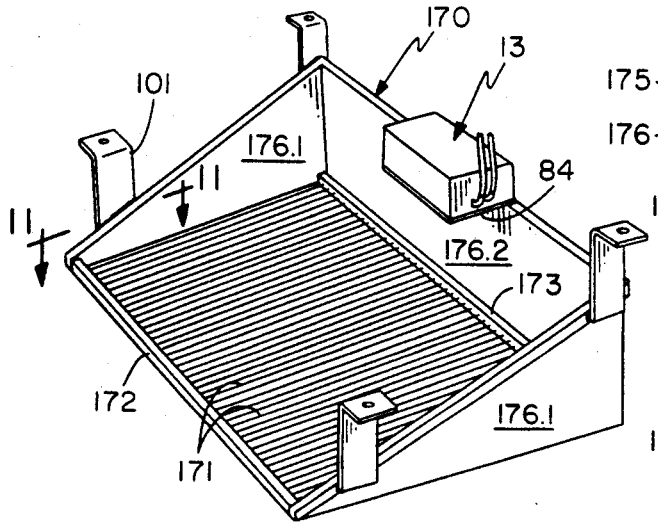
FIG. 10 is a perspective view of an alternate embodiment of the invention showing a harp-type screen.
Figure 11:
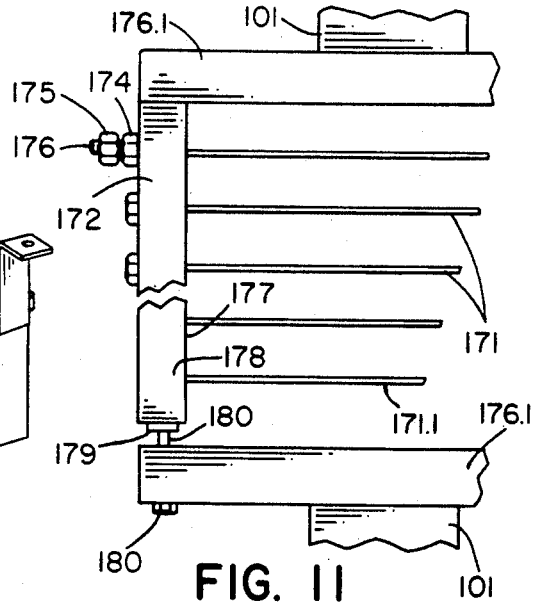
FIG. 11 is a detailed partially broken away view of a portion of the harp-type screen shown in FIG. 10, and of another harp screen embodiment.

As shown in FIGS. 10 and 11, an alternate embodiment of the invention includes a harp-type screen bucket 170. The floor portion 171 of such a bucket includes no cross-over wires; the screen cloth includes only wires running parallel to each other and forming elongate slots therebetween from a front support member 172 to a rear support member 173. The distance between each of the wires is typically one-eighth to seven-sixteenths inches depending on the type of sand to be screened. With no cross-over wires, sand is screened more quickly. To show one type of harp screen, the Gellhaus U.S. Pat. No. 4,162,968 is hereby incorporated by reference.

A pair of lock nuts 174, 175 on threaded pin 176 form a tension adjustment means for pulling each of the wires 171 taut. An end of each of the wires 171 is set in one of the pins 176. The pins 176 and wires 171 extend through apertures in the cross support members 172, 173. The side and rear portions of the screen bucket 170 may include respective solid plates or walls 176.1, 176.2. A rear portion of the screen bucket 170 includes a vibrator 13 mounted on the plate 84. When a seven-sixteenth inch harp-type screen is utilized, the attachment 10 may clean one-half acre to one and one-half acres of coral sand per hour with the cutting edge 14 disposed two inches into the sand. Another type of harp screen includes a cloth 177.1 crimped into an elongate edge 177 of an elongate U-channel 178. A take-up bar 179 is typically disposed in the U-channel 178. The take-up bar 179 is adjustably mounted to side portions 176.1 via a pin 180 in a horizontal slot such that the harp screen 171.1 is drawn taut as a whole.

Figure 12:
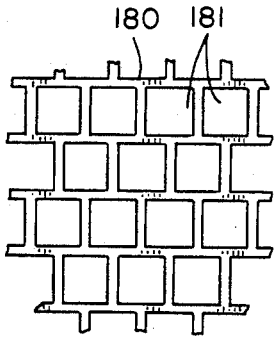
FIG. 12 is partial view of a punch plate steel screen utilized for screening black dirt.

As shown in FIG. 12, an alternate embodiment of the invention includes a steel punch plate screen 180 with square apertures 181. Such a punch plate screen 180 is typically utilized for screen black dirt. As an alternative to the square apertures 181, a punch plate with round apertures may be utilized.

Figure 13:
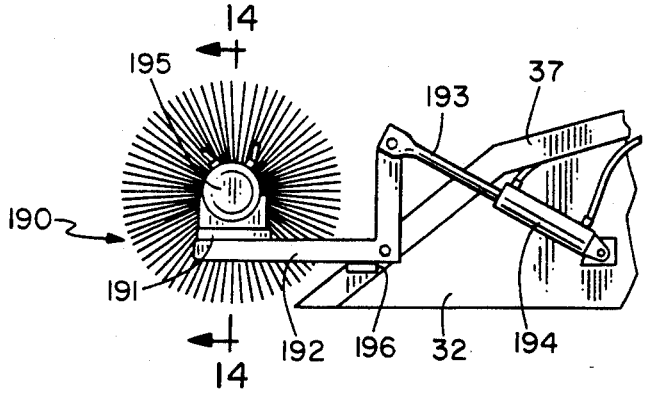
FIG. 13 is a partial view of an alternate embodiment of the invention showing a roller broom disposed adjacent to the blade and swingable by a hydraulic cylinder to an out-of-the-way position.

As shown in FIG. 13, another alternate embodiment of the invention includes a roller or power broom 190 swingably mounted on a front portion of the primary bucket 11. One end 191 of the broom 190 is mounted on an L-shaped mount 192 pivotally connected to the flange 37 of one of the side plates 32. One end of the L-shaped mount 192 is pivotally affixed to a piston end 193 of a hydraulic cylinder 194, which in turn is pivotally affixed to one of the side plates 32 of the primary bucket 11. The other end of the power broom 190 may be connected in a like manner to the other side plate 32. The power broom 190 further includes an electric motor 195. The length of the broom 190 is approximately equal to the width of the screen bucket 12. Pivotal supports 196 on both of the flanges 37 engage the L-shaped mount 192 to support the broom 190 and align the circumference of the fiberglass bristles 197 with the surface of the beach and adjacent to the cutting edge 15 of the blade 14. The broom 190 is utilized typically on hard sand to sweep litter and its accompanying sand into the screen bucket 12. The broom 190 is swingable to an out-of-the-way position by retracting the piston ends 193.

Figure 14:
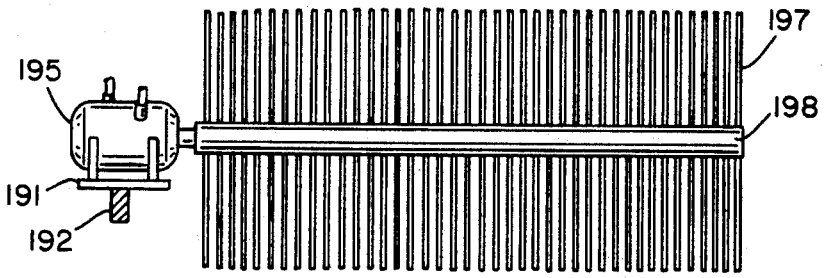
FIG. 14 is a front elevation view of the roller broom of FIG. 13 with bristles.
Figure 14A:
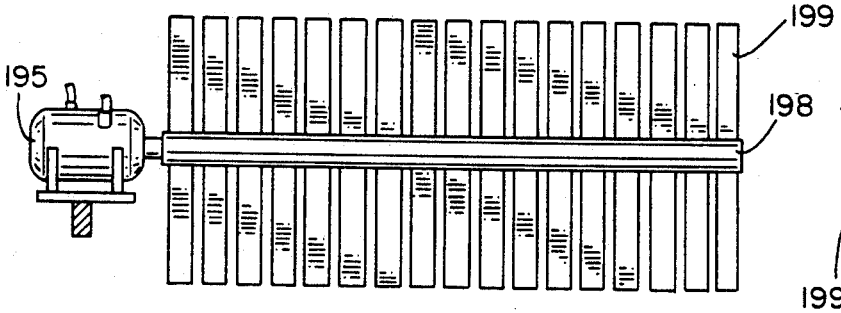
FIG. 14*a* is a front view of a roller broom with resilient strips.
Figure 15:
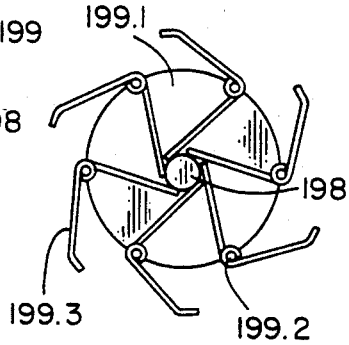
FIG. 15 is a cross-section of a roller broom with tension mounted tines.

As shown in FIG. 14, the fiberglass bristles 197 are disposed on a shaft 198 which is typically driven at 50 rpm. Alternatively as shown in FIG. 14A, resilient rubber-like straps or strips 199 are mounted on the shaft 198. Two or more sets of diametrically extending strips 199 may extend from the shaft 198. As shown in FIG. 15, a number of disks 199.1 are rigidly mounted on the power broom shaft 198 and include circumferentially disposed pins 199.2. Each of the pins 199.2 mounts a tension spring-like tine 199.3, each of Which includes an end bearing against the shaft 198. Such tines 199.3 may be used in thatching operations.

Figure 16:
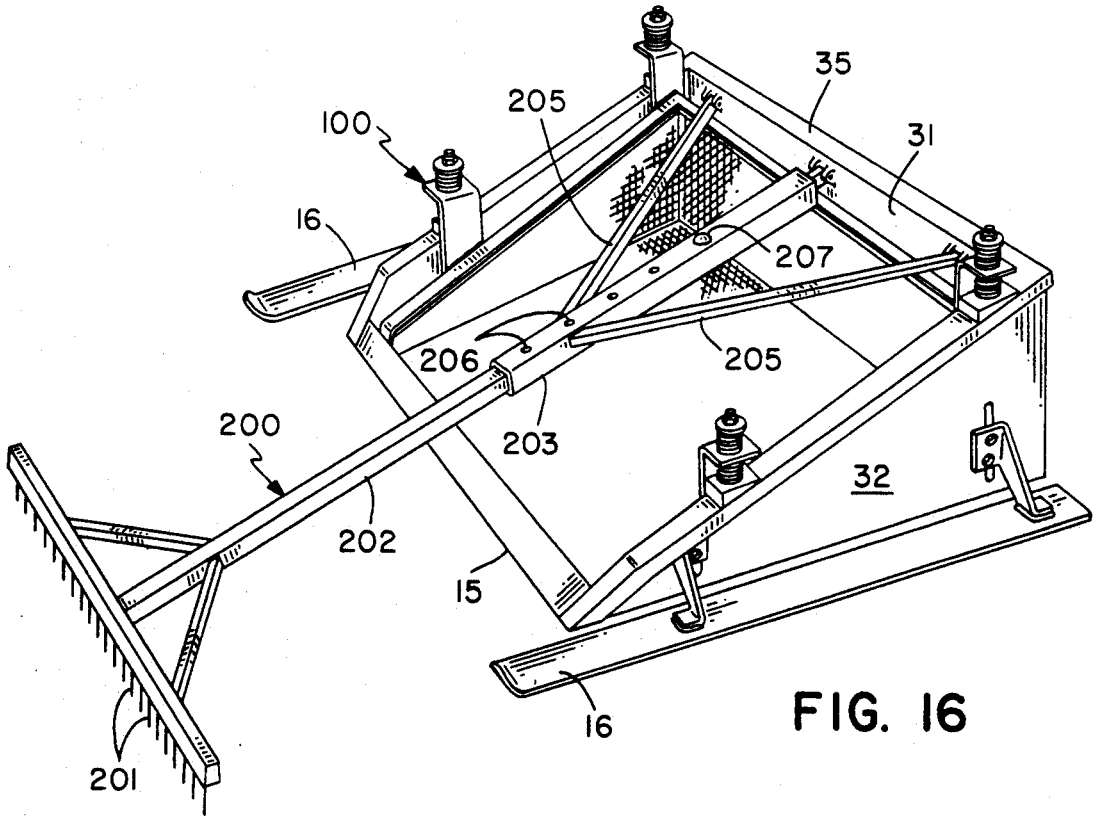
FIG. 16 is a perspective view of an alternate embodiment of the invention showing a telescoping rake mountable on the bucket for raking seaweed from a shoreline.

As shown in FIG. 16, another alternate embodiment of the invention includes an extendable rake 200. The rake 200 includes a row of projecting teeth 201, and two front and rear telescoping portions 202, 203. The rear telescoping portion 203 is pivotally affixed to the rear plate 31 of the primary bucket 11. Two braces 205 extend from the rear portion 203 to be pivotally affixed to the rear plate 31. The telescoping portions 202, 203 include alignable holes 206 for receiving a pin 207. The rake 200 may be extended 10–30 feet beyond the blade 14 to, for instance, rake seaweed from a shoreline. The rake 200 may be swingable via the pivotal connections to an out of the way position such that the screening bucket 12 may be used. In this embodiment, the vibrator 13 is typically connected to a rear portion of the screen bucket 12, and extends through an opening formed in the rear of the primary bucket 11.

Figure 17:
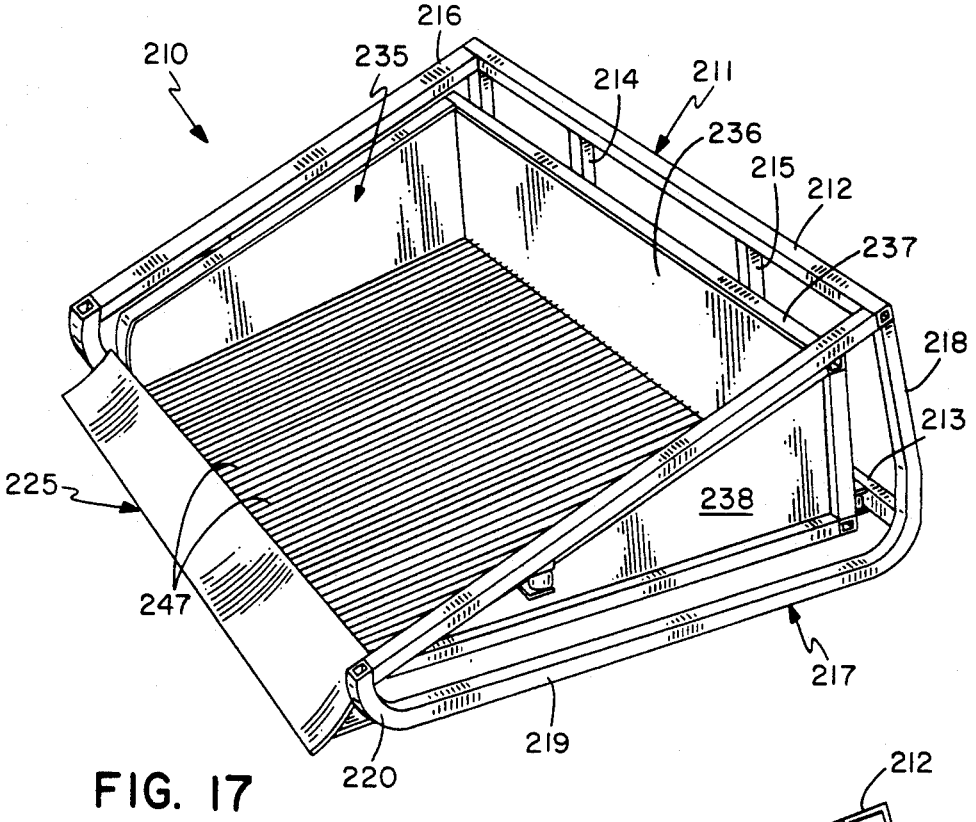
FIG. 17 is a perspective view of a preferred embodiment of the vibrating screen bucket attachment.
Figure 18:
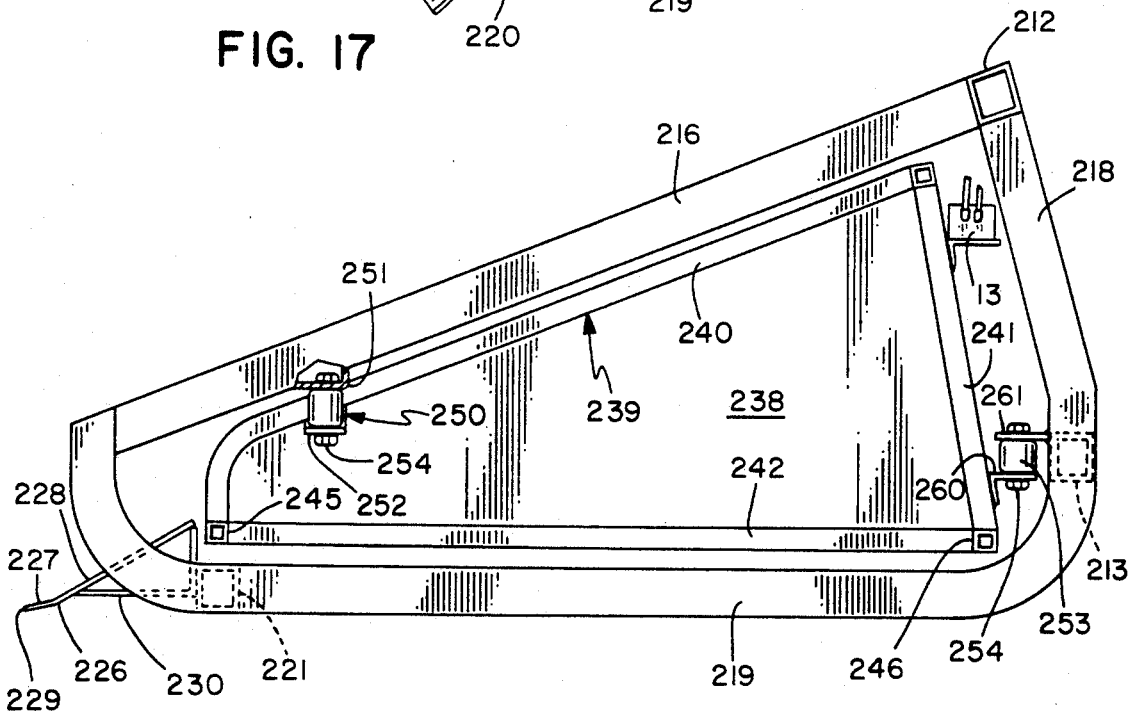
FIG. 18 is a side elevation, partially broken away, partially phantom view of the attachment of FIG. 17.

As shown in FIG. 17, a preferred attachment 210 includes a primary excavating bucket 211 which is typically formed of a frame of 2"×2"×10 gauge steel square tubing. A rear portion of the frame includes upper and lower horizontal members 212, 213 with vertical members 214, 215 connected between the members 212, 213. Members 214, 215 include ears for attachment to a mobile machine such as a skid-steer loader. Each of the end portions of the frame of the bucket 211 includes an oblique, upper member 216 and an integral lower member 217 with a rear upright portion 218, a bottom portion 219 for engaging a beach, and a curved front portion 220 which may decrease resistance of the attachment 210 as it traverses a beach. A front cross member 221 is connected between forward portions of the bottom portions 219.

A blade 225 is mounted between the front curved portions 220 and to the front cross member 221. The blade 225 includes an oblique plate 226 with a 10° sloping portion 227 and a greater sloping portion 228. Blade portion 227 includes a cutting edge 229. A right-angled blade portion 230 rigidly connects the plate 226 to the cross member 221.

An inner vibrating bucket 235 is typically formed of a frame of 1"×1"×10 gauge steel square tubing. A rear plate 236 is framed by rectangular tubular frame 237. Each of two generally triangular end plates 238 are framed by a generally triangular, end, tubular frame 239 with upper tubing 240, rear tubing 241 and lower tubing 242. The vibrator 13 is mounted on a plate affixed to an upper central portion of the rear plate 236. The inner bucket 235 further includes front and rear cross members 245, 246 rigidly connected between lower tubing members 242. A harp-type screen 247 is connected between the cross members 245, 246.

A set of four resilient mounts 250 connect the buckets 211, 235 and provide vibration suppressing means for suppressing vibrations of the inner vibrating bucket 235 relative to the outer excavating bucket 236. Each of the oblique upper members 216 include a frontward angle bracket 251 and each of the upper tubing portions 240 include a cooperating frontward angle bracket 252. Frontward resilient bumper pads or grommets 253 are mounted between flat portions of the brackets 251, 252 via removable pin connectors 254.

Two of the resilient mounts 250 are disposed on rear portions of the buckets 211, 235. Each of the rear tubing portions 241 of the inner bucket 235 includes an angle bracket 260 and the horizontal lower member 213 of the outer bucket 211 includes a pair of angle brackets 261. Rearward bumper pads 253 on pin connectors 254 are disposed between flat portions of the brackets 260, 261. The amplitude of the vibrations of the inner bucket 235 is adjusted by turning the pin connectors 254 such that the respective brackets 251, 254 and 260, 261 are drawn together to squeeze the bumper pads 253 therebetween.

It should be noted that as well as cleaning debris from beaches, the present invention may be utilized for screening roots and lumps out of black dirt for use in yards and nurseries, especially with the punch plate screen 180; for cleaning lawns of sticks and stones, especially with the broom implements having fiberglass bristles 197, straps 199, and thatching tines 199.3; for picking up nails and metal mixed with debris on parking lots, scrap yards and lumber years, especially with the electromagnet embodiment 120; for picking up balled up oil and grease; for picking up undesirable rocks and debris at parks and desert land; for picking up dead fish and seaweed at the shoreline; for scarifying and then picking up dead or undesirable sod from yards; for scarifying blacktop or concrete driveways and then removing the undesirable oversized pieces from the road base; for sweeping highways and road shoulders, especially with the fiberglass bristles 197 and straps 199; and for picking up oranges, grapefruit, and pecans from groves.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed is:

1. A vibrating bucket screen attachment for picking up debris from a surface with particles, and for connection to the arm structure and hydraulic system of a mobile machine, comprising:

a) a frame having front, side, and rear portions and comprising:

1) mounting means for attachment to the arm structure and hydraulic system of the mobile machine;

2) support means for supporting the frame relative to the surface and engaging the surface at respective locations adjacent the side portions, the respective locations defining a generally horizontal plane; and 3) a blade on the front portion of the frame and having a generally horizontally extending elongate cutting edge for engaging the surface and picking up the debris and particles as the mobile machine is driven on the surface, the cutting edge being disposed in or below the plane defined by the support means; and b) a vibrating separator bucket resiliently mounted within the frame to minimize transmission of vibrations to the frame, the bucket comprising:

1) vibration means for vibrating the bucket;

2) a pair of upwardly extending transversely walls and an upwardly extending rear wall between the transverse walls; and 3) a bottom vibrating particulate screen portion for screening the debris and particles flowing across the blade and into the bucket, the screen portion being fixed to the transverse and rear walls to form the bucket, the screen portion further being:

i) disposed rearwardly of and adjacent to the blade;

ii) spaced from the blade to aid in minimizing transmission of vibrations to the blade and frame; and iii) disposed above the cutting edge of the blade and the plane defined by the support means such that the screen portion is spaced from the surface whereby the debris remains in the bucket and the particles pass through the screen portion to return to the surface.

2. The attachment of claim 1, wherein at least one of the upwardly extending walls of the bucket comprises a solid portion.

3. The attachment of claim 1, wherein the bucket is mounted on the frame with means for adjusting the amplitude of the vibrations of the bucket.

4. The attachment of claim 1, wherein the blade is adjustable relative the support means of the frame such that the cutting edge of the blade is disposable to penetrate the surface at different depths.

5. The attachment of claim 1, wherein the upwardly extending transverse walls comprise a pair of frame members disposed opposite of each other and the bucket further comprises a plurality of screen wires running parallel to each other and connected to the frame members, each of the adjacent pair of screen wires forming an elongate slot extending between the frame members to form a harp screen to separate the debris from the particles more quickly.

6. The attachment of claim 1, wherein the screen portion comprises an aperture punch plate.

7. The attachment of claim 1, wherein the vibration means is operated by the hydraulic system of the mobile machine.

8. The attachment of claim 1, wherein the bucket includes the rear wall being resiliently mounted on the frame.

9. The attachment of claim 1, wherein the bucket includes a front portion which is resiliently mounted on the frame.

10. The attachment of claim 1, wherein the support means includes friction reducing means for supporting the frame relative to the surface and for reducing friction between the attachment and the surface.

11. The attachment of claim 10, wherein the friction reducing means includes a runner.

12. The attachment of claim 10, wherein the friction reducing means includes a wheel.

13. The attachment of claim 10, wherein the friction reducing means is adjustable relative the cutting edge for adjusting the depth at which the cutting edge digs into the surface.

14. The attachment of claim 1 and further comprising sweeping means disposed forwardly of and adjacent to the elongate cutting edge for sweeping the debris and particles over the blade and into the separator bucket.

15. The attachment of claim 14, wherein the sweeping means comprises a powered roller broom with bristles.

16. The attachment of claim 14, wherein the sweeping means comprises a powered roller with resilient strips.

17. The attachment of claim 14, wherein the sweeping means comprises a powered roller with rigid, tension-mounted tines.

18. The attachment of claim 1 and further comprising magnetic means on the separator for attracting and holding metallic debris.

19. The attachment of claim 18, wherein the magnetic means comprises an electromagnet traversing the separator bucket adjacent the cutting blade, the electromagnet being deactivatable to release metallic debris from the attachment.

20. The attachment of claim 1 and further comprising a telescoping rake mounted on the frame and being extendable forwardly of the cutting edge to perform raking operations.

21. The attachment of claim 1, wherein the support means comprises elongate bottom portions integral with the side portions of the frame.

22. A vibrating bucket screen attachment for picking up debris from a surface with particles, and for connection to the arm structure and hydraulic system of a mobile machine, comprising a) a frame for an excavating bucket comprising:
   1) mounting means for attachment to the arm structure and hydraulic system of the mobile machine,
   2) side portions with bottom portions for engaging the surface, the bottom portions defining a plane,
   3) a forwardly disposed blade with a horizontally extending elongate cutting edge between the side portions for traversing the surface and picking up the debris and particles, the cutting edge being disposed in or below the plane defined by the bottom portions,
   4) means for rigidly spacing apart the side portions, and
   5) an open portion between the side portions; and b) a vibrating bucket resiliently mounted in and spaced from the frame such that transmission of vibrations to the frame is minimized and comprising:
   1) vibration means for vibrating the vibrating bucket;
   2) a pair of sidewalls disposed transversely of each other;
   3) a rear wall disposed transversely of the blade; and
   4) a particulate screen floor portion disposed rearwardly of, spaced from and adjacent to the blade and above the cutting edge of the blade and bottom portions for screening the debris from the particles, the debris remaining in the vibrating bucket, the particles falling through the screen and open portion and back to the surface as the attachment traverses the surface.

23. A vibrating bucket screen attachment for picking up debris from a surface with particles, and for connection to the arm structure and hydraulic system of a mobile machine, comprising a) a frame for an excavating bucket comprising:
   1) a rear frame portion with mounting means for attachment to the arm structure and hydraulic system of the mobile machine,
   2) a pair of end frame portions disposed transversely of each other and extending forwardly from the rear frame portion, the end portions having bottom portions for engaging the surface, the bottom portions defining a plane, each of the end frame portions having curved front portions curving upwardly from the bottom portions,
   3) a blade with an elongate cutting edge and being mounted between the curved front portions of the end frame portions, the blade engaging the surface and scooping up the debris and particles, the cutting edge being disposed in or below the plane defined by the bottom portions and
   4) an open portion disposed between the bottom portions for allowing particles to return to the surface;

b) a vibrating bucket shaped to fit in the frame and comprising:
   1) a rear plate disposed transversely of the blade,
   2) a pair of end plates transversely of each other and extending forwardly from the rear plate,
   3) a particulate screen mounted between the end plates and between the rear plate and the blade, the screen rearwardly of, adjacent to and spaced from the blade, the screen spaced above the bottom portions of the end frame portions, and
   4) a hydraulically operated vibrator on the rear plate and being operated by the hydraulic system of the mobile machine; and c) resilient means for mounting the vibrating bucket in the frame and for suppressing vibrations of the vibrating bucket relative to the blade and frame such that transmission of vibrations to the frame is minimized whereby the particles and debris flowing across the blade and onto the screen are separated by the screen, the debris being retained in the vibrating bucket and the particles passing through the screen and falling back to the surface as the attachment traverses the surface.

* * * * *

UNITED STATES PATENT AND TRADEMARK OFFICE

CERTIFICATE OF CORRECTION

PATENT NO. : 5,160,034

DATED : November 3, 1992

INVENTOR(S) : Robert J. Potter

It is certified that error appears in the above-identified patent and that said Letters Patent is hereby corrected as shown below:

Column 5, line 6, after "disposed", delete "o" and replace it with --on--.

Column 8, line 46, after "of", deleted "Which" and replace it with --which--.

Column 10, line 39, after "extending", delete "transversely" and replace it with --transverse--.

Column 12, line 57, after "plates", delete "transversely" and replace it with --transverse--.

Signed and Sealed this

Fifth Day of October, 1993

*Attest:*

Bruce Lehman

BRUCE LEHMAN

*Attesting Officer*

*Commissioner of Patents and Trademarks*